US005388823A

United States Patent [19]

Prieto

[11] Patent Number: 5,388,823

[45] Date of Patent: Feb. 14, 1995

[54] ADJUSTABLE BASEBALL BATTING TEE

[75] Inventor: Ronald G. Prieto, Bricktown, N.J.

[73] Assignee: BASE-ICS Inc., Bricktown, N.J.

[21] Appl. No.: 224,299

[22] Filed: Apr. 7, 1994

[51] Int. Cl.[6] ..... A63B 69/40

[52] U.S. Cl. ..... 273/26 R

[58] Field of Search ..... 273/26 R, 25, 26 E, 273/29 A

[56] References Cited

U.S. PATENT DOCUMENTS

| | | | |
|---|---|---|---|
| 3,139,282 | 6/1964 | Lande | 273/26 R |
| 4,227,691 | 10/1980 | Lefebvre et al. . | |
| 4,664,374 | 5/1987 | Groves | 273/26 R |
| 4,709,924 | 12/1987 | Wilson | 273/26 R |
| 4,796,885 | 2/1989 | Wright | 273/26 R |
| 4,819,937 | 4/1989 | Gordon . | |
| 4,962,924 | 10/1990 | James | 273/26 R |
| 4,989,866 | 2/1991 | Dill . | |
| 5,004,234 | 4/1991 | Hollis | 273/26 R |

*Primary Examiner*—Theatrice Brown

*Attorney, Agent, or Firm*—Oblon, Spivak, McClelland, Maier & Neustadt

[57] ABSTRACT

An adjustable batting tee includes a first elongated member attached to a plate member. Slidably positioned on the first elongated member is a second elongated member. The second elongated member is positioned cross-wise with respect to the first elongated member and is rotatable with respect to the first elongated member. The second elongated member is rotatable between at least first and second positions, and an upright member for supporting a baseball is slidably positioned on the second elongated member. The relatively movable members in combination with the rotational second elongated member permits the positioning of a ball provided on the upright member in a variety of locations within a strike zone so as to provide a training apparatus for properly teaching hitting techniques to right-handed and left-handed batters.

10 Claims, 5 Drawing Sheets

ADJUSTABLE BASEBALL BATTING TEE

BACKGROUND OF THE INVENTION

1. Field of the Invention

The present invention relates to an adjustable baseball batting tee having a slidable upright member for supporting a baseball and first and second elongated members in which one of the elongated members is slidable and rotatable with respect to the other one of the elongated members so as to position the upright member and the baseball supported thereon at a plurality of locations within a strike zone.

2. Description of the Related Art

Batting tees are known for improving the hitting of baseball players and particularly young players who are learning to play the game of baseball. A conventional batting tee utilizes an adjustable upright member which extends directly upward from the center of a home plate shaped support member. This type of batting tee has a drawback in that since the ball is supported in the center of home plate, the batting tee is not capable of properly simulating the various possible locations of a baseball within a strike zone. Therefore, this type of baseball batting tee cannot properly teach a young player to hit a ball when it is in front of the plate since the ball is directly over the plate.

Other known adjustable batting tees have drawbacks in that the amount of positional adjustments of the ball-supporting upright member with respect to home plate is limited. That is, conventional batting tees cannot properly simulate outside pitches and inside pitches with respect to home plate and with respect to left-handed and right-handed batters. Additionally, conventional adjustable batting tees cannot properly simulate outside pitches, inside pitches and pitches at the middle of home plate, based on the position of the ball with respect to the ball's distance from home plate.

SUMMARY OF THE INVENTION

Accordingly, an object of the present invention is to provide for a novel adjustable baseball batting tee which is capable of simulating the position of a baseball at various locations within a strike zone.

A further object of the present invention is to provide for an adjustable baseball batting tee which can position a baseball in a preferred hitting zone and serves as a training device for teaching the proper relationship between the batter, the ball and home plate.

A further object of the present invention is to provide for an adjustable baseball batting tee which can be used as a trainer to teach the proper batting stance, stride, swing, etc., to a player.

The adjustable batting tee of the present invention comprises a plate member; a first elongated member extending from the plate member; a second elongated member slidably and rotatably positioned on the first elongated member and extending cross-wise with respect to the first elongated member, the second elongated member being slidable along a length of the first elongated member and being rotatable with respect to the first elongated member between at least first and second positions; locking means for selectively locking the second elongated member in the first and second positions; and an upright member for supporting a ball, the upright member being slidably mounted on the second elongated member so as to be slidable along a length of the second elongated member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
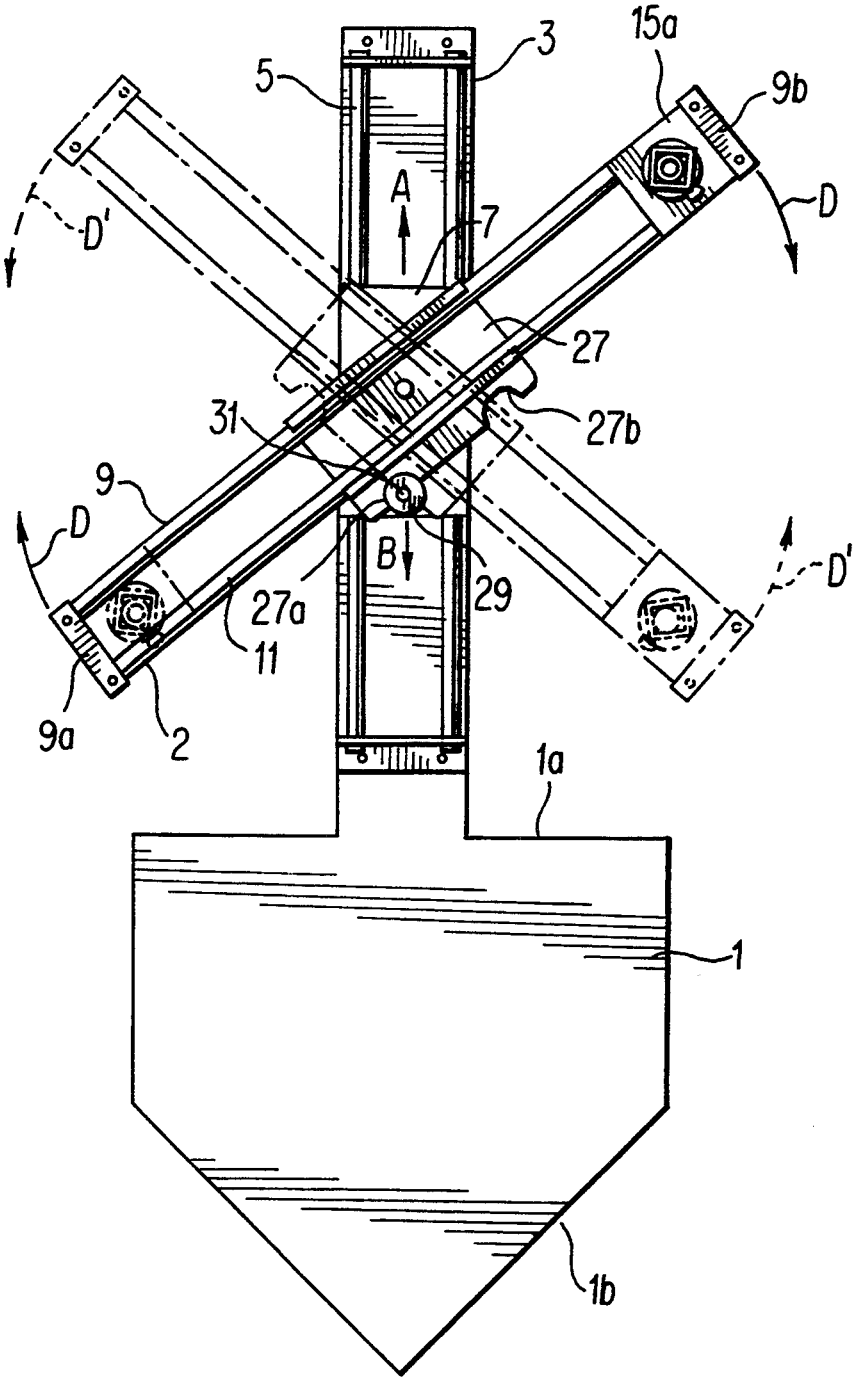
FIG. 1 is a top view of the adjustable batting tee of the present invention.

Referring now to the drawings, wherein like reference numerals designate identical or corresponding parts throughout the several views, and more particularly to FIG. 1. This figure shows a plate member 1 which is shaped in the form of home plate in baseball and can be placed on the ground or any flat surface. Extending perpendicularly from the center of a front end 1*a* of the plate member 1 is a first elongated member 3 having guide bar means 5. Slidably positioned on the first elongated member 3 is a sliding member 7 having apertures 7*a* (FIGS. 2 and 3) which correspond to the guide bar means 5 of the first elongated member 3 for permitting the sliding member 7 to slide along the guide bar means in the directions illustrated by arrows A and B. Accordingly, the sliding member 7 is slidable along a length of the first elongated member 3 to move away from or towards the front end 1*a* of the plate member 1. Rotatably positioned on the sliding member 7 in a cross-wise manner with respect to said first elongated member 3 is a second elongated member 9 which is rotatable about the point 31 as illustrated by arrow D. The second elongated member 9 comprises guide bar means 11 extending across the length of the second elongated member 9. The second elongated member 9 includes a first end portion 9*a* and a second end portion 9*b*.

Figure 2:
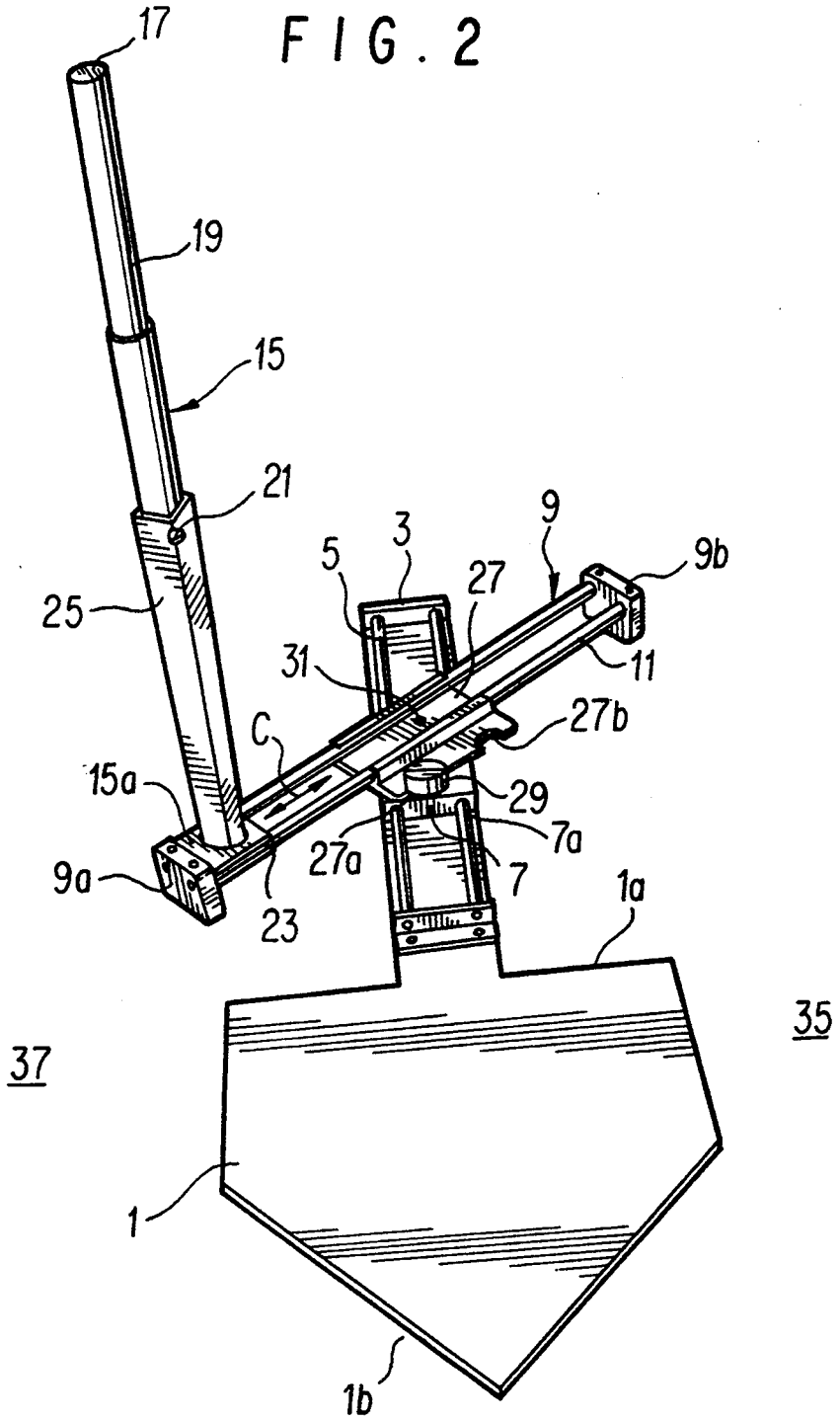
FIG. 2 is a perspective view of the adjustable baseball batting tee of the present invention adjusted for training a left-handed hitter.
Figure 3:
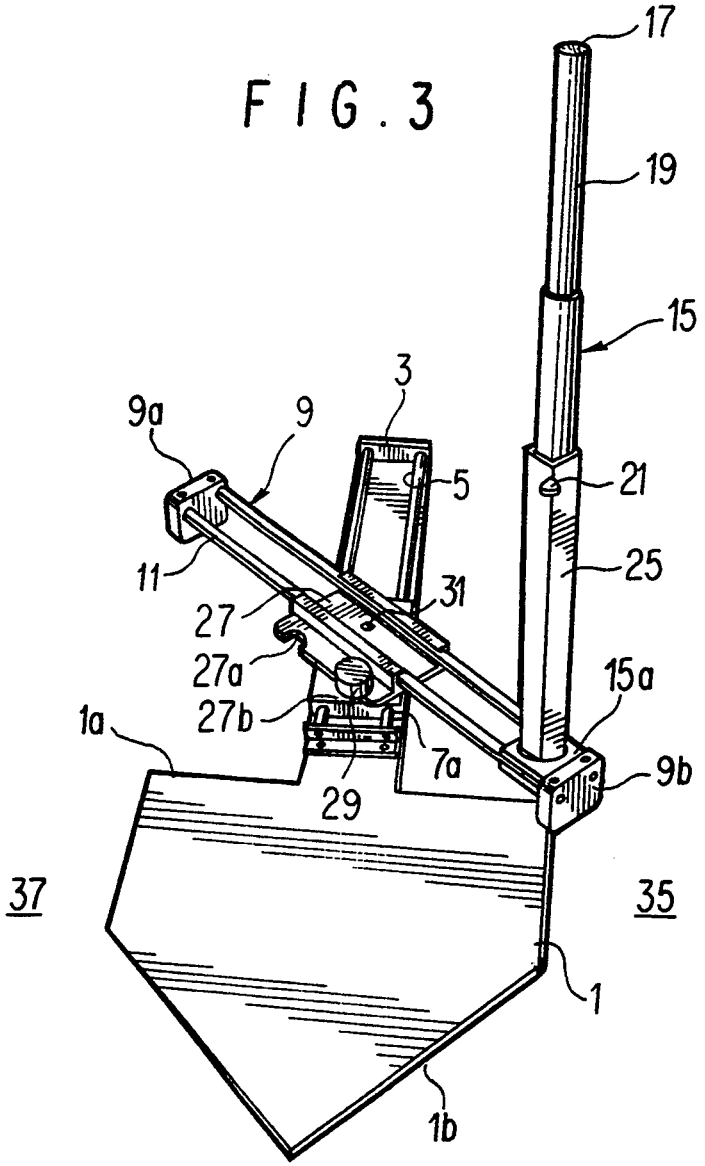
FIG. 3 is a perspective view of the baseball batting tee of the present invention adjusted for training a right-handed hitter.

Referring now to FIGS. 2 and 3, slidably positioned on the second elongated member 9 so as to be slidable between the first end portion 9*a* and the second end portion 9*b* in the directions illustrated by double arrow C, is an upright member 15 having a supporting surface 17 for supporting a baseball. The upright member 15 includes a flexible adjustable telescoping portion 19 which is slidably positioned in a tube portion 25. An adjustable tightening member 21 on the tube portion 25 can be utilized to selectively set the height of the telescoping portion 19 and thereby adjust the vertical positioning of the baseball. So as to permit the above-noted sliding of the upright member 15 along the length of the second elongated member 9, a base portion 15*a* of the upright member 15 includes openings 23 which cooperate with the guide bar means 11 of the second elongated member 9. The tubular portion 25 of the upright member 15 is mounted in a screw-type manner on the base portion 15*a* so as to be rotatable about its own longitudinal axis. When the tubular portion 25 of the upright member 15 is rotated in a first direction, the interconnection between the tubular portion 25 and the base portion 15*a* is tightened to compress the base portion 15*a* on the guide bar means 11 so as to secure the position of the upright member 15 on the second elongated member 9. When it is desired to slide the upright member 15 along the second elongated member 9, the tubular portion 25 is rotated in an opposite direction so as to loosen the interconnection between the tubular portion 25 and the base portion 15*a* so as to permit the sliding of the upright member 15 along the guide bar means 11 of the second elongated member 9.

Mounted on the second elongated member 9 is a substantially flat plate 27 having first 27*a* and second 27*b* openings. The first 27*a* and second 27*b* openings cooperate with an adjustable locking mechanism 29 positioned on the sliding member 7 so as to selectively lock the second elongated member 9 in first and second locking positions. The first locking position is illustrated in FIG. 2 and is also illustrated by the solid line in FIG. 1. The second locking position is illustrated in FIG. 3 and is also illustrated by the dash-dot line in FIG. 1. The second elongated member 9 is selectively rotatable about the point 31 as illustrated by arrows D and D' in FIG. 1. The adjustable locking mechanism 29 can be a rotatable screw type mechanism which can be rotated to lock the second elongated member 9 in place or a spring loaded plastic, rubber or flexible button-type mechanism which can be pressed to lock the second elongated member 9 in place.

FIG. 2 and the solid line of FIG. 1 illustrates an adjustment position of the batting tee for training a left-handed hitter to hit a baseball which is on the outside portion of the plate 1 with respect to a left-handed hitter who generally stands in area 35. As illustrated in FIG. 2, the slidable member 7 with the second elongated member 9 attached thereon is slid in a direction away from the plate to a desired position, and the second elongated member 9 is rotated about the point 31 so as to engage the first opening 27*a* of the flat plate 27 with the adjustable locking member 29. The adjustable locking member 29 is then tightened so as to lock the second elongated member 9 in the position illustrated in FIG. 2. The tubular portion 25 of the upright member is rotated about its own longitudinal axis so as to loosen the connection between the tubular portion 25 and the base portion 15*a*. The upright member 15 is then slid along the second elongated member 9 to a position adjacent to the first end portion 9*a* of the second elongated member 9 as illustrated in FIG. 2. The tubular portion 25 is then rotated about its own longitudinal axis in the opposite direction to secure the tubular member 25 in the above-noted position. The height of upright member 15 is thereafter adjusted by manipulating the telescoping portion 19 and the tightening member 21 to achieve the desired height. A baseball can then be placed on the ball-supporting surface 17. As noted above, this specific position can be utilized to train left-handed hitters to hit an outside pitch.

If a left-handed hitter is to be trained to hit a pitch at the middle of the plate 1, the second elongated member 9 is maintained in the first locked position illustrated in FIG. 2 and the tubular portion 25 is loosened as noted above and slid along the second elongated member 9 in a direction toward end portion 9*b* to a position above the first elongated member 3 which simulates a pitch at the middle of the plate 1. The tubular member 25 is then tightened as described above. Since a pitch at the middle of a plate 1 needs to be hit at a certain distance away from the plate 1, with the arrangement of the present invention, the sliding of the upright member 15 in a direction away from the first end portion 9*a* not only positions the upright member 15 at the center of the plate 1, but also positions the upright member 15 at a specific distance away from the front 1*a* of the plate 1 which is suitable for hitting a pitch at the middle of the plate.

If a left-handed batter is to be trained to hit an inside pitch, the second elongated member 9 is maintained in the first locked position illustrated in FIG. 2, and the upright member 25 is loosened as described above and slid further towards the second end portion 9*b* so as to be in the opposite end portion 9*b* of the second elongated member 9. The tubular portion is then tightened as described above. For left-handed batters, when hitting an inside pitch, it is important that the ball be positioned a greater distance from home plate 1 than a pitch at the outside or the middle of the plate 1. The sliding of the upright member 15 towards the second end portion 9*b* not only achieves the positioning of the upright member 15 for simulating an inside pitch, but also serves to position the upright member 15 a specific distance away from the front of home plate 1 which is suitable for hitting an inside pitch.

Additionally, the concept of having the slidable member 7 and the second elongated member 9 attached thereon movable along the length of the first elongated member 3 towards and away from home plate 1, serves to train batters which like to stand close to the front 1*a* of the plate or stand toward the rear 1*b* of the plate 1. This is due to the fact that the movement of the slidable member 7 along the first elongated member 3 compensates for ball players who as noted above, either stand close to the front of the plate 1 or the rear of the plate 1.

As illustrated in FIG. 3 and the dash-dot line of FIG. 1, for training right-handed hitters who generally stand in area 37 to hit an outside pitch, the second elongated member 9 can be rotated about the point 31 in the opposite direction to the direction of rotation in FIG. 2 so as to engage the second opening 27*b* of the flat plate 27 with the adjustable locking member 29. The adjustable locking member 29 is then locked so as to lock the second elongated member 9 in the position illustrated in FIG. 3. The tubular member 25 of the upright member 15 is rotated as explained above and the upright member 15 is then slid along the length of the second elongated member 9 to a position adjacent to the second end portion 9*b* of the second elongated member 9. The height of the upright member 15 is then adjusted as noted above to a desired height and a baseball is placed on the ball supporting surface 17.

As explained above with respect to a left-handed hitter, a right-handed hitter can be trained to hit inside pitches, pitches at the middle of the plate and outside pitches. Due to the position of the second elongated member 9 with respect to home plate 1, a right-handed hitter can learn to hit an outside pitch at a position where the pitch is relatively close to the plate 1 as illustrated in FIG. 3, a pitch at the middle of the plate at a position where the ball is farther away from the plate than an outside pitch, and an inside pitch at a position where the ball is farthest away from the plate since it is important for the hitter to swing early so as to properly hit the ball. This is achieved by sliding the upright member in a direction toward the end portion 9*a* of the second elongated member 9.

Therefore, the present invention permits the positioning of a baseball at a variety of locations with respect to home plate 1 so as to properly train a player to hit a ball no matter what position the ball is in with respect to home plate 1. For example, the slidable member 7 can be moved towards and away from home plate 1 so as to compensate for players who stand close to the front 1*a* of the plate 1 or towards the rear *b* of the plate 1. The second elongated member 9 can be rotated about the point 31 in a first direction or a second direction depending on whether the batter is left-handed or right-handed. The upright member 15 can be slid along the length of the second elongated member 9 depending on whether the batter is left-handed or right-handed. Also, the angle of the second elongated member 9 with respect to the first elongated member 3 in combination with the upright member 15 being slidable along the second elongated member 9 properly trains a hitter to hit outside pitches when the ball is close to the plate, and inside pitches when the ball is further from the plate.

The second elongated member 9 has a length which permits the upright member 15 to be Slid along a distance which simulates the width of the strike zone in baseball. Thus, regardless of the positioning of the second elongated member 9 with respect to the first elongated member 3, the present invention properly simulates a strike zone and therefore can positively train a player to hit a baseball at any position within the strike zone.

When the second elongated member 9 is rotated so as to be positioned in the first locked position as illustrated in FIG. 2 and the solid line in FIG. 1, an angle $\alpha$ (FIG. 1) which is defined between the second elongated member 9 and a line which is perpendicular to the first elongated member 3 is preferably between 38 and 40 degrees. The same applies when the second elongated member 9 is locked in the second locked position of FIG. 3. This angle and positioning properly simulates a desired hitting zone so that the baseball can be positioned within a variety of positions within the hitting zone.

The plate member 1, first elongated member 3, second elongated member 9 and upright member 15 can be made of any sturdy material such as aluminum or hard plastic while the telescoping member 19 can be made of a resinous or plastic flexible material which will bend but not break if a batter swings too low and accidently hits the telescoping portion 19.

Figure 4:
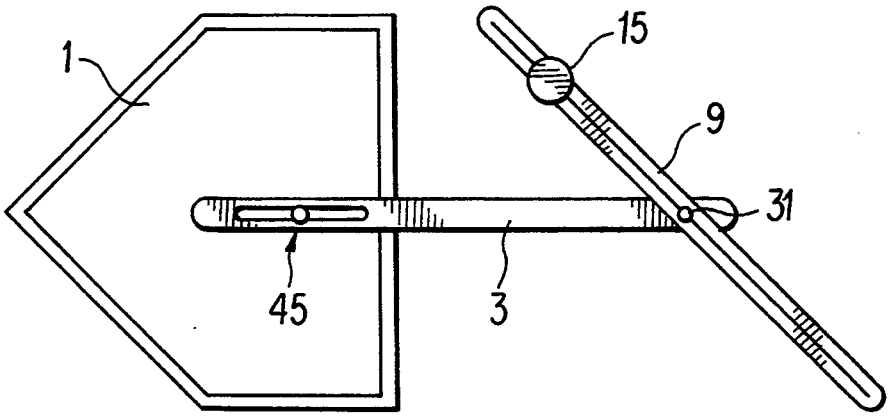
FIG. 4 is a top view of a further embodiment of the adjustable baseball batting tee of the present invention.
Figure 5:
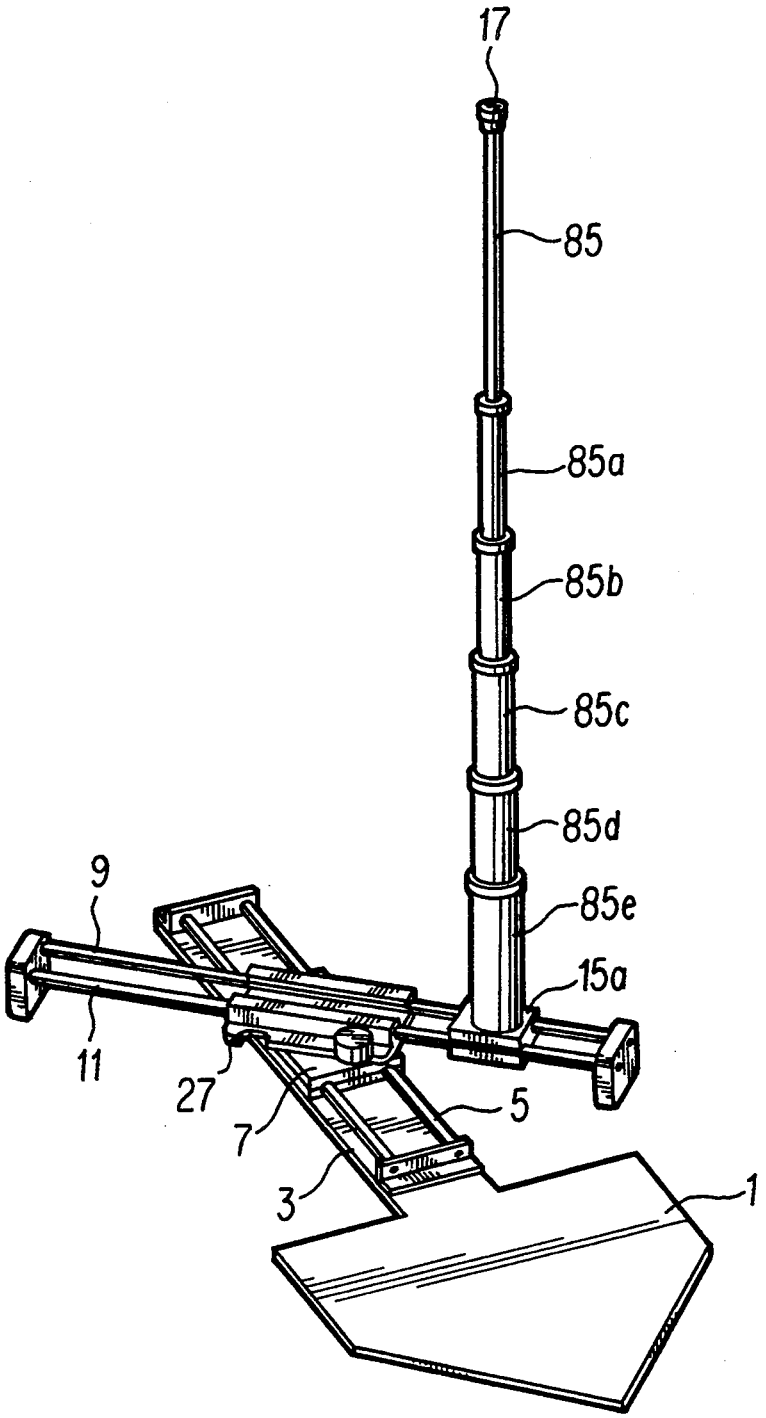
FIG. 5 is a perspective view of a further embodiment of the adjustable baseball batting tee of the present invention.
Figure 6:
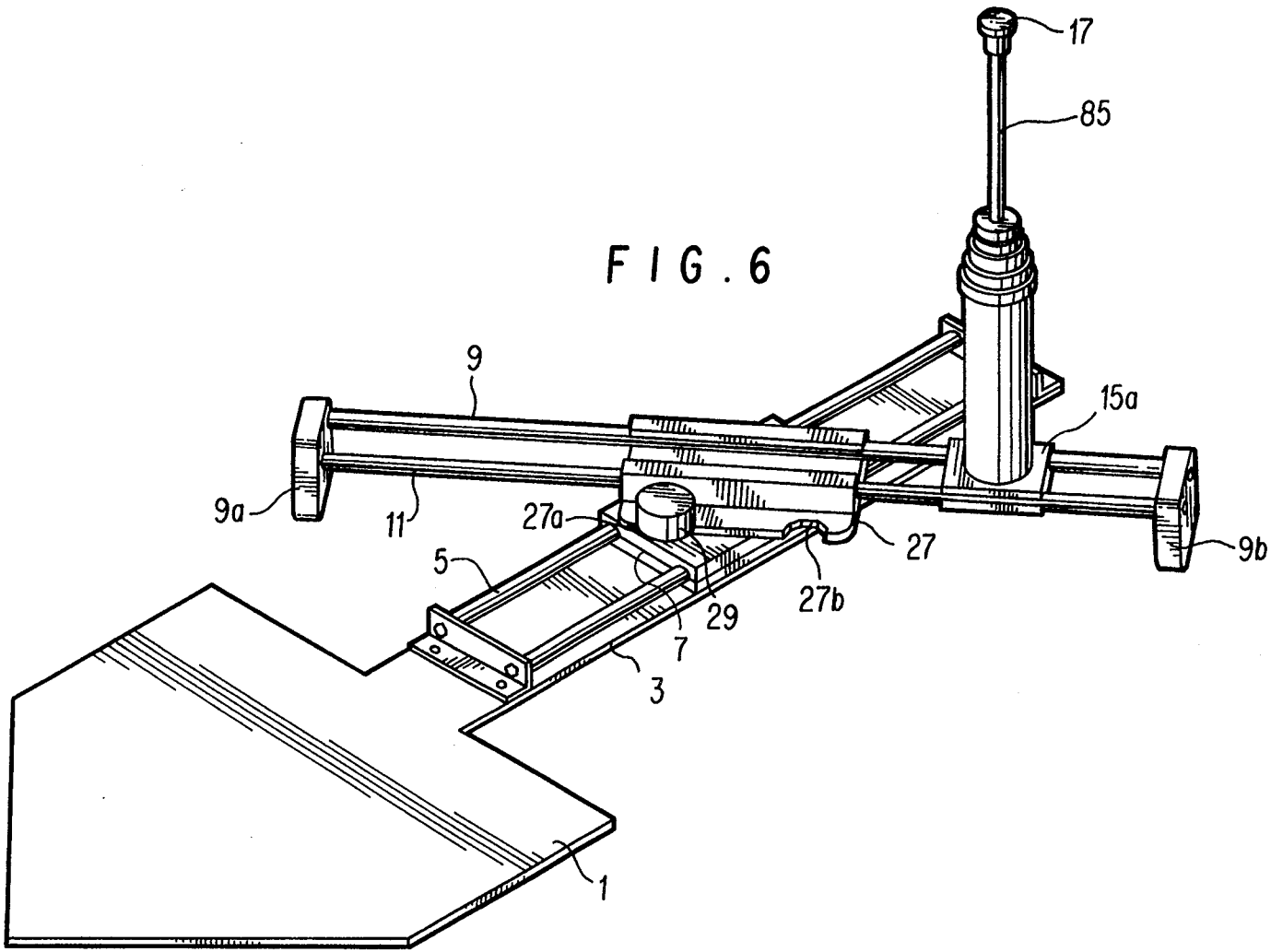
FIG. 6 is a further view of the embodiment of FIG. 5.

As a further embodiment illustrated in FIG. 4, the first and second elongated members 3 and 9 can be rotatably attached to each other and the first elongated member 3 can be slidably positioned on the plate member 1 by way of a slidable connection 45. Also, as illustrated in FIGS. 5 and 6, instead of the telescoping portion 9, a thin flexible whip-like portion 85 which is bendable if a batter hits the flexible portion can be utilized. This can be useful in training young players since it minimizes the size of the support 17 for the baseball and therefore simulates a pitched baseball. This also permits the hitter to concentrate only on the baseball. The embodiment of FIGS. 5 and 6 is similar to the embodiment of FIGS. 1–3 but instead of using the combination of the tubular portion 25 and the telescoping portion 19 for supporting the baseball and adjusting the vertical height of the baseball, the embodiment of FIGS. 5 and 6 as noted above utilizes a thin flexible whip-like portion 85 which is slidably mounted on telescoping members 85*a*–85*e*. The telescoping members 85*a*–85*e* are slidably positioned within each other so as to be slidable from the low position illustrated in FIG. 6 to the high position illustrated in FIG. 5 and vice versa. The thin flexible whip-like portion 85 can be made of a resinous plastic material or other material which can bend but will not break if a batter mistakenly swings too low and hits the flexible portion 85 as opposed to the ball which is mounted on the support 17. The telescoping members 85*a*–85*e* can be made of a plastic material or metallic material and basically depends on design considerations.

With the embodiments of FIGS. 5 and 6, due to the size of the thin flexible whip-like portion 85, a batter can more positively focus on the ball which is mounted on the ball supporting surface 17.

With the structure of the present invention, once you position the second elongated member 9 in one of the first and second locked positions of FIGS. 2 and 3 for respectively training a left-handed or right-handed hitter, a sliding of the upright member 15 along the second elongated member 9 is all that is required for simulating outside or inside pitches. The inclination of the second elongated member 9 with respect to the first elongated member 3 automatically provides the proper spacing of the ball in front of the plate 1 depending on whether the ball is positioned inside or outside with respect to the hitter.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An adjustable batting tee comprising:

a plate member having a front portion and a rear portion;

a first elongated member extending perpendicularly from a center of said front portion of said plate member;

a slidable member positioned on said first elongated member so as to be slidable along a length of said first elongated member;

a second elongated member having first and second oppositely disposed end portions and being rotatably mounted to said slidable member so as to be slidable along said length of said first elongated member and rotatable with respect to said first elongated member, said second elongated member extending cross-wise with respect to said first elongated member and being rotatable with respect to said first elongated member from a first position in which said first end portion of said second elongated member is closer to said front portion of said plate member than said second end portion, to a second position in which said second end portion of the second elongated member is closer to said plate member than said first end portion;

locking means for selectively locking said second elongated member in said first and second positions; and an upright member for supporting a ball, said upright member being slidably mounted on said second elongated member so as to be slidable along a length of said second elongated member between said first and second end portions of the said elongated member.

2. An adjustable batting tee according to claim 1, wherein said first elongated member comprise first guide bar means, said slidable member being slidably positioned to slide along said first guide bar means.

3. An adjustable batting tee according to claim 2, wherein said second elongated member comprises second guide bar means, said upright member being slidably positioned to slide along said second guide bar means.

4. An adjustable batting tee according to claim 1, wherein said locking means comprises:

a substantially flat plate having first and second openings, said flat plate being attached to said second elongated member; and an adjustable locking member attached to said slidable member, said adjustable locking member being insertable into said first opening of said flat plate when said second elongated member is in said first position for locking said second elongated member in said first position, and insertable into said second opening of said plate when said second elongated member is in said second position for locking said second elongated member in said second position.

5. An adjustable batting tee according to claim 1, wherein said upright member comprises a tubular portion and a telescoping portion slidably positioned in said tubular portion for permitting a height adjustment of said upright member.

6. An adjustable batting tee according to claim 5, wherein said upright member further includes a base portion, said tubular portion of said upright member being rotatably connected to said base portion such that rotation of said tubular portion in a first direction tightens a connection between said base portion and said tubular portion so as to secure said upright member at a selected position on said second elongated member, and a rotation of said tubular portion in a second opposite direction loosens said connection between said tubular portion and said base portion to permit said upright member to slide along said second elongated member.

7. An adjustable batting tee according to claim 1, wherein said upright member comprises a thin flexible whip-like portion mounted on a telescoping member.

8. An adjustable batting tee comprising:

a plate member;

a first elongated member having a first longitudinal axis and extending from said plate member;

a second elongated member slidably and rotatably positioned on said first elongated member, said second elongated member having a second longitudinal axis which crosses the first longitudinal axis of said first elongated member, said second elongated member being slidable along a length of said first elongated member and being rotatable with respect to said first elongated member, between at least first and second positions;

locking means for selectively locking said second elongated member in said first and second positions; and an upright member for supporting a ball, said upright member being slidably mounted on,said second elongated member so as to be slidable along a length of said second elongated member.

9. An adjustable batting tee according to claim 8, wherein said upright member comprises means for selectively adjusting a height of said upright member.

10. An adjustable batting tee comprising:

a plate member;

a first elongated member having a first longitudinal axis and extending from said plate member, said first elongated member being slidable with respect to said plate member;

a second elongated member rotatably positioned on said first elongated member, said second elongated member having a second longitudinal axis which crosses the first longitudinal axis of said first elongated member, said second elongated member being rotatable with respect to said first elongated member, between at least first and second positions;

locking means for selectively locking said second elongated member in said first and second positions; and an upright member for supporting a ball, said upright member being slidably mounted on said second elongated member so as to be slidable along a length of said second elongated member.

* * * * *